US009030106B2

(12) United States Patent
Li

(10) Patent No.: US 9,030,106 B2
(45) Date of Patent: May 12, 2015

(54) DRIVING CIRCUIT AND LED BACKLIGHT MODULE USING MULTIPLE REFERENCES VOLTAGES

(75) Inventor: Fei Li, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 483 days.

(21) Appl. No.: 13/379,887

(22) PCT Filed: Dec. 2, 2011

(86) PCT No.: PCT/CN2011/083370

§ 371 (c)(1),
(2), (4) Date: Dec. 21, 2011

(87) PCT Pub. No.: WO2013/075359

PCT Pub. Date: May 30, 2013

(65) Prior Publication Data

US 2013/0127351 A1 May 23, 2013

(51) Int. Cl.
*H05B 37/00* (2006.01)
*H05B 33/08* (2006.01)

(52) U.S. Cl.
CPC ..... *H05B 33/0851* (2013.01)

(58) Field of Classification Search
CPC ..... H05B 33/0851; H05B 33/0827; H05B 33/0815
USPC ..... 315/185 S, 247, 291, 307, 312–326
See application file for complete search history.

(56) References Cited

U.S. PATENT DOCUMENTS

| | | | | |
|---|---|---|---|---|
| 7,999,482 | B2 * | 8/2011 | Takeuchi | 315/224 |
| 8,004,207 | B2 | 8/2011 | Elder | |
| 8,018,170 | B2 * | 9/2011 | Chen et al. | 315/192 |
| 8,169,156 | B2 * | 5/2012 | Hsu et al. | 315/291 |
| 2013/0127351 | A1 * | 5/2013 | Li | 315/192 |

FOREIGN PATENT DOCUMENTS

| | | | |
|---|---|---|---|
| CN | 1531383 | A | 9/2004 |
| CN | 201893977 | U | 7/2011 |
| TW | 201108865 | A1 | 3/2011 |

OTHER PUBLICATIONS

Szolusha, "DC/DC Converter Drives White LEDs from a Variety of Power Sources", 2004.*
International Search Report for PCT/CN2011/083370.

* cited by examiner

*Primary Examiner* — Douglas W Owens
*Assistant Examiner* — Borna Alaeddini

(57) ABSTRACT

A driving circuit for a LED backlight module includes a brightness adjusting module, a current detector, a reference voltage adjusting module, and a comparing module. The current detector is capable of detecting the current of the brightness adjusting module and outputting a detecting result. The reference voltage adjusting module is capable of choosing the corresponding reference voltage corresponding to the detecting result of the current detector. Thus, the reference voltage outputted to the comparing module can be adjusted according to the change of the current of the brightness adjusting module. This reduces the power consumption and the amount of heat generated due to the power consumption, and improves the performance of the LED backlight module.

8 Claims, 2 Drawing Sheets

DRIVING CIRCUIT AND LED BACKLIGHT MODULE USING MULTIPLE REFERENCES VOLTAGES

BACKGROUND

1. Technical Field

The present disclosure relates to LEDs, and particularly, to a driving circuit and a LED backlight module using the same.

2. Description of Related Art

Generally, a driving circuit is used in a LED backlight module for driving LEDs. A constant reference voltage equal to 0.6V or 0.8V is often provided in the driving circuit. The reference voltage is outputted to a voltage comparator to be compared with a sample voltage, thus, the currents of the LEDs can be adjusted to be constant according to the comparing result. In another aspect, the driving circuit may further include a constant current source for providing a current to each LED. The current can be changed to adjust a brightness of each LED. However, since the reference voltage remains unchanged and thus causes a bias voltage of a MOS transistor to remain unchanged, therefore, a certain amount of power consumption is generated when the current flows through other parts of the driving circuit. For example, when the reference voltage is equal to 0.8V and the current flows through the driving circuit is equal to 960 mA, the power consumption in the driving circuit may reach 0.768 W, which is converted to heat generated by the driving circuit. Due to the small size of the driving circuit, the heat may influence the driving circuit a lot to influence the performance and lifetime of the driving circuit.

SUMMARY

The present disclosure provides a driving circuit for a LED backlight module. The driving circuit includes a load, a constant current source, a comparing module connected to the constant current source, a brightness adjusting module connected to the load, a reference voltage adjusting module, and a current detector. The brightness adjusting module is connected to the comparing module and the load for adjusting a brightness of the load, and includes at least one MOS transistor. A gate of each MOS transistor is connected to a micro control unit or a system on chip as an input terminal, a drain thereof is connected to the comparing module, and a source thereof is grounded via a resistor. The current detector is connected to the bright driving module for detecting a current of the brightness adjusting module, outputting a detecting result. The reference voltage adjusting module is connected to the current detector for receiving the detecting result and connected to the comparing module for supplying an adjustable reference voltage to the comparing module. The reference voltage adjusting module includes four voltages scales respectively corresponding to the reference voltages of 0.3 volts (0.3V), 0.4V, 0.6V, and 0.8V. The reference voltage adjusting module is capable of choosing the corresponding voltage scale according to the detecting result and outputting the reference voltage corresponding to the chosen voltage scale to the comparing module.

Preferably, the load includes a number of LED strings respectively connected to the drain of the corresponding MOS transistor.

Preferably, the comparing module includes a voltage comparator.

The present disclosure still provides another driving circuit for a LED backlight module. The driving circuit includes a load, a constant current source connected to the load, a comparing module connected to the constant current source, a brightness adjusting module connected to the comparing module and the load for adjusting a brightness of the load, a current detector connected to the bright driving module, and a reference voltage adjusting module connected to the current detector for receiving the detecting result and connected to the comparing module for supplying an adjustable reference voltage to the comparing module. The reference voltage adjusting module includes at least two voltage scales corresponding to two reference voltages respectively. The reference voltage adjusting module is capable choosing the corresponding voltage scale according to the detecting result and outputting the reference voltage corresponding to the chosen voltage scale to the comparing module.

Preferably, the brightness adjusting module includes at least one MOS transistor, a gate of each MOS transistor is connected to a micro control unit or a system on chip as an input terminal, a drain thereof is connected to the comparing module, and a source thereof is grounded via a resistor and connected to the current detector.

Preferably, the load includes a number of LED strings respectively connected to the drain of the corresponding MOS transistor.

Preferably, the reference voltage adjusting module includes four of the voltage scales respectively corresponding to the reference voltages of 0.3V, 0.4V, 0.6V, and 0.8V.

Preferably, the comparing module includes a voltage comparator.

The present disclosure further provides a LED backlight module having a driving circuit. The driving circuit includes a load, a constant current source connected to the load, a comparing module connected to the constant current source, a brightness adjusting module connected to the comparing module and the load for adjusting a brightness of the load, a current detector connected to the brightness adjusting module, and a reference voltage adjusting module connected to the current detector for receiving the detecting result and connected to the comparing module for supplying an adjustable reference voltage to the comparing module. The reference voltage adjusting module includes at least two voltage scales corresponding to two reference voltages respectively. The reference voltage adjusting module is capable choosing the corresponding voltage scale according to the detecting result and outputting the reference voltage corresponding to the chosen voltage scale to the comparing module.

Preferably, the brightness adjusting module includes at least one MOS transistor, a gate of each MOS transistor is connected to micro control unit or a system on chip, a drain thereof is connected to the comparing module, and a source thereof is grounded via a resistor and connected to the current detector.

Preferably, the load includes a number of LED strings respectively connected to the drain of the corresponding MOS transistor.

Preferably, the reference voltage adjusting module includes four of the voltage scales respectively corresponding to the reference voltages of 0.3V, 0.4V, 0.6V, and 0.8V.

Preferably, the comparing module includes a voltage comparator.

In the present disclosure, the current detector is capable of detecting the current of the brightness adjusting module and outputting the detecting result to the reference voltage adjusting module to allow the reference voltage adjusting module to choose the corresponding reference voltage scale and output the corresponding reference voltage. Therefore, the reference voltage can be adjusted according to the change of the current of the brightness adjusting module. This reduces the power consumption and the amount of heat generated due to the power consumption, and improves the performance of the LED backlight module.

DESCRIPTION OF THE DRAWINGS

Many aspects of the embodiments can be better understood with reference to the following drawings. The components in the drawings are not necessarily dawns to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment is this disclosure are not necessarily to the same embodiment, and such references mean at least one.

Figure 1:
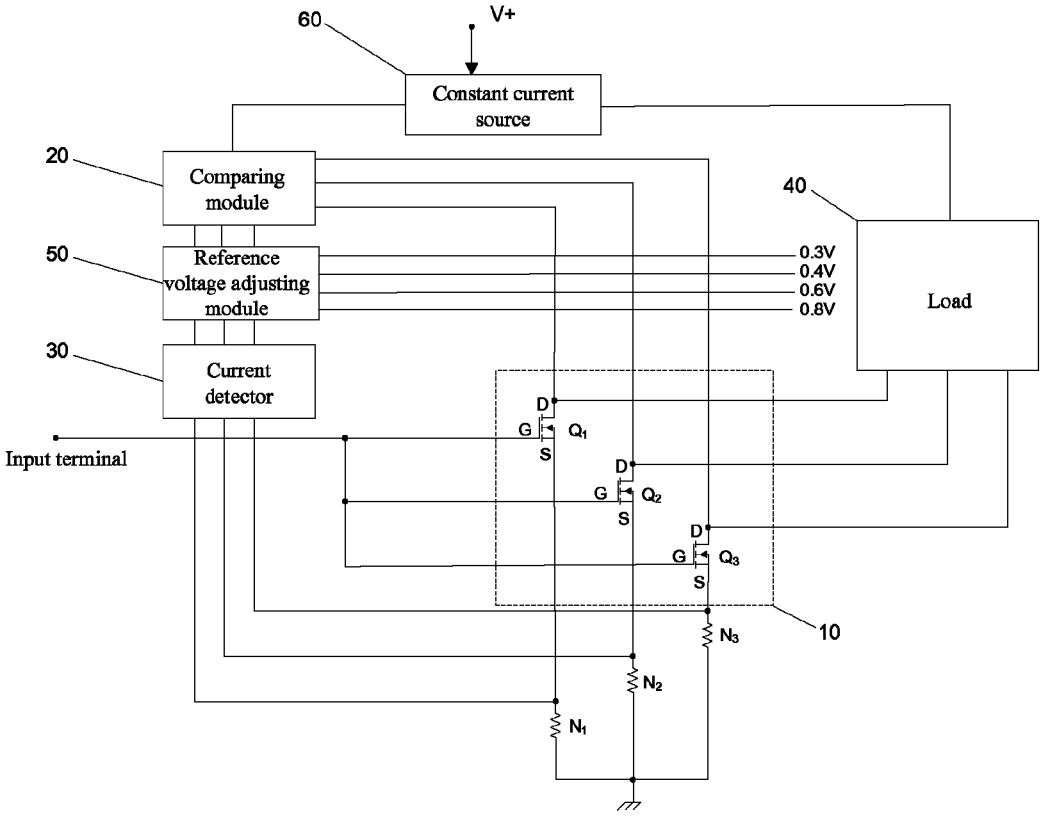
FIG. 1 is a schematic view of a driving circuit of a LED backlight module in accordance with a first embodiment of the present disclosure.

Referring to FIG. 1, a driving circuit of a LED backlight module in a first embodiment includes a comparing module 20, a current detector 30, a load 40, a brightness adjusting module 10 connected to the comparing module 20, the current detector 30, and the load 40, a reference voltage adjusting module 50 connected to the comparing module 20 and the current detector 30, a constant current source 60 connected to the comparing module 20 and the load 40, three resistors N1, N2, and N3 connected to the brightness adjusting module 10.

The brightness adjusting module 10 is used for outputting a number of driving signals to the load 40 and adjusting a brightness of the load 40. The brightness adjusting module 10 includes at least one MOS transistor. In the embodiment, the brightness adjusting module 10 includes three of MOS transistors Q1, Q2, and Q3. A gate G of the transistor Q1 is connected to a micro control unit (MCU) or a system on chip (SoC) as an input terminal, a drain D thereof is connected to the comparing module 20 and the load 40, and the source S thereof is connected to the current detector 30 and is grounded via the resistor N1. Both the gates G of the transistors Q2, Q3 are also connected to the MCU or the SoC as the input terminals, both the drains D of the transistors Q2, Q3 are also connected to the comparing module 20 and the load 40. The source S of the second MOS transistor Q2 is grounded via the resistor N2 and the source S of the third MOS transistor Q3 is grounded via the resistor N3.

The current detector 30 is connected to the sources S of the three MOS transistors Q1, Q2, and Q3 for detecting the current of the brightness adjusting module 10 and outputting a detecting result.

The reference voltage adjusting module 50 is used for receiving the detecting result from the current detector 30 and supplying an adjustable reference voltage to the comparing module 20 according to the detecting result. The reference voltage adjusting module 50 includes at least two voltages scales corresponding at least two reference voltages. In the embodiment, the reference voltage adjusting module 50 includes for voltage scales respectively corresponding to four reference voltages of 0.3V, 0.4V, 0.6V, and 0.8V. That is, the reference voltage adjusting module 50 is connected to four voltage supplies which respectively supply four following reference voltages of 0.3V, 0.4V, 0.6V, and 0.8V. After the detecting result is received, the reference voltage adjusting module 50 is capable of choosing the corresponding voltage scale and outputting the corresponding reference voltage.

The comparing module 20 is used for receiving the reference voltage from the reference voltage adjusting module 50, detecting a bias voltage of the load 40, and comparing the received reference voltage with the bias voltage to generate a comparing result. The comparing module 20 in the embodiment may include a voltage comparator for comparing the reference voltage with the bias voltage.

The constant current source 60 is connected to the comparing module 20 and the load 40. The constant current source 60 is capable of receiving the comparing result from the comparing module 20 and outputting a stable constant current to the load 40 according to the comparing result.

In operation, the current detector 30 detects the current of the brightness adjusting module 10 and outputs the detecting result. The reference voltage adjusting module 50 receives the detecting result and chooses the corresponding voltage scale to output the reference voltage corresponding to the chosen voltage scale to the comparing module 20. For example, when the current of the brightness adjusting module 10 is detected to range from 150-200 mA, the reference voltage adjusting module 50 chooses the voltage scale corresponding to the reference voltage of 0.8V; when the current of the brightness adjusting module 10 is detected to range from 80-150 mA, the reference voltage adjusting module 50 chooses the voltage scale corresponding to the reference voltage of 0.6V; when current of the brightness adjusting module 10 is detected to range from 1-80 mA, the reference voltage adjusting module 50 chooses the voltage scale corresponding to the reference voltage of 0.4V, and when current of the brightness adjusting module 10 is detected to be less than 1 mA, the reference voltage adjusting module 50 chooses the voltage scale corresponding to the reference voltage of 0.3V. After the reference voltage is received, the comparing module 20 compares the reference voltage with the bias voltage of the load 40 to generate the comparing result to control the constant current source 60 to output the stable current to the load 40.

From the above description, it can be concluded that when the current of the brightness adjusting module 10 changes, the reference voltage adjusting module 50 is capable of outputting the corresponding reference voltage accordingly. Thus, the reference voltage in the embodiment is adjustable to reduce the power consumption and a amount of heat generated due to the consumed energy, and further to improve the performance and the lifetime of the driving circuit. For example, when the current of the brightness adjusting module 10 is equal to 100 mA, the power consumption of the driving circuit in the embodiment only reaches $0.6\times0.1=0.06$ W, while in the conventional driving circuit, the power consumption may reach as much as $0.8\times0.1=0.08$ W with the unchanged reference voltage 0.8V.

Figure 2:
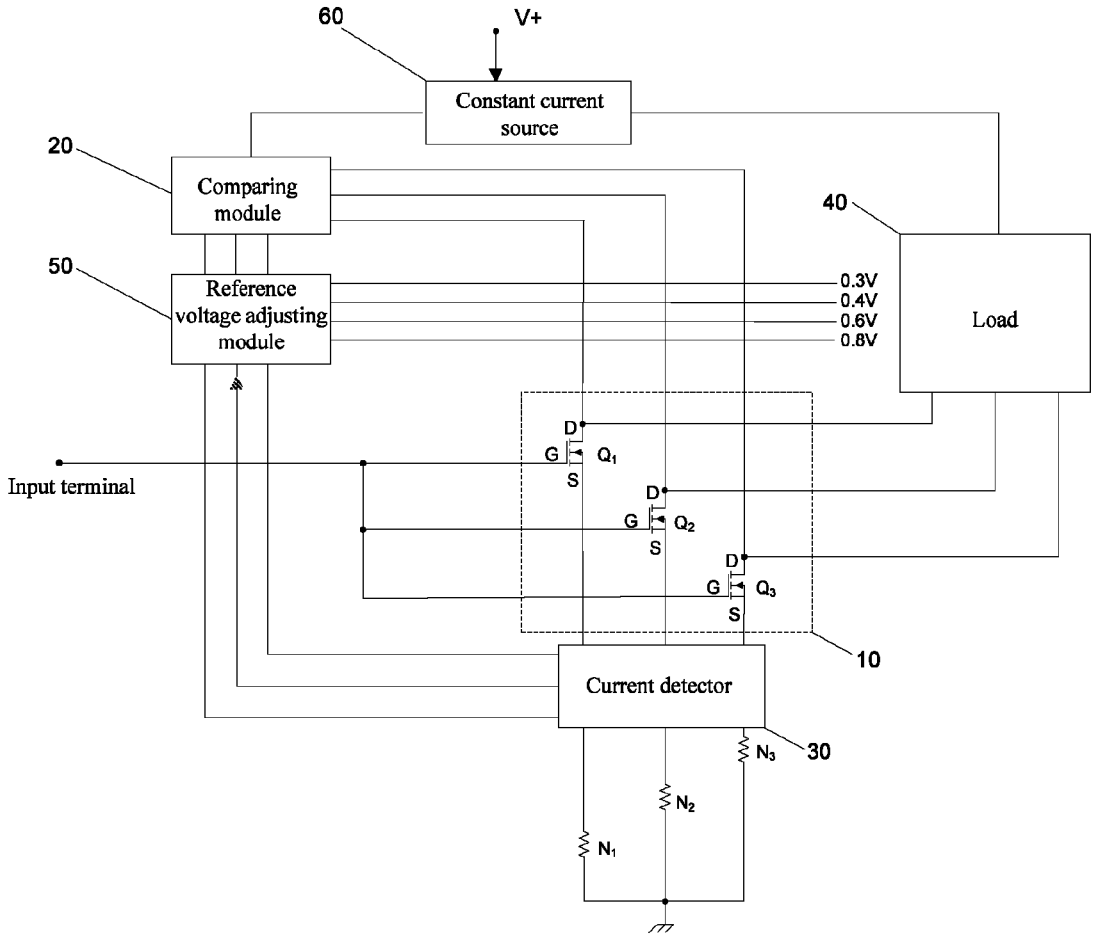
FIG. 2 is a schematic view of a driving circuit of a LED backlight module in accordance with a second embodiment of the present disclosure.

Referring to FIG. 2, in a second embodiment, compared with that of the first embodiment, the current detector 30 detects three currents of the three resistors N1, N2, and N3, and outputs the detecting result to the reference voltage adjusting module 50. The reference voltage adjusting module 50 receives the detecting result and chooses the voltage scale corresponding to the detecting result, and further outputs the corresponding reference voltage to the comparing module 20. Thus, the comparing module 20 can compare the received reference voltage with the bias voltage of the load 40 to control the constant current source 60 to output the stable constant current.

The present disclosure further provides a backlight module with the above driving circuit.

With the current detector 30 for detecting the current of the brightness adjusting module 10, the reference voltage adjusting module 50 can choose the corresponding voltage scale and outputting the corresponding reference voltage to the comparing module 20 according to the detecting result of the current detector 30. Thus, the reference voltage outputted to the comparing module 20 is adjustable in response to the change of the current of the brightness adjusting module 10. This reduces the power consumption and the amount of heat generated due to the power consumption, and improves the performance and lifetime of the LED backlight module.

Even though information and the advantages of the present embodiments have been set forth in the foregoing description, together with details of the mechanisms and functions of the present embodiments, the disclosure is illustrative only; and that changes may be made in detail, especially in matters of shape, size, and arrangement of parts within the principles of the present embodiments to the full extend indicated by the broad general meaning of the terms in which the appended claims are expressed.

What is claimed is:

1. A driving circuit for a LED backlight module, comprising:

a load;

a constant current source connected to the load for outputting a stable constant current to the load;

a comparing module connected to the constant current source;

a brightness adjusting module connected to the comparing module and the load for adjusting a brightness of the load, the brightness adjusting module comprising at least one MOS transistor, a gate of each MOS transistor being connected to a micro control unit or a system on chip as an input terminal, a drain thereof being connected to the comparing module, and a source thereof being grounded via a resistor;

a current detector connected to the source of the corresponding MOS transistor for detecting a current of the brightness adjusting module and generating a detecting result; and a reference voltage adjusting module connected to the current detector for receiving the detecting result and connected to the comparing module for supplying an adjustable reference voltage to the comparing module, the reference voltage adjusting module comprising four voltage scales respectively corresponding to the reference voltages of 0.3V, 0.4V, 0.6V, and 0.8V, and the reference voltage choosing the corresponding voltage scale according to the detecting result and outputting the reference voltage corresponding to the chosen voltage scale to the comparing module.

2. The driving circuit as claimed in claim 1, wherein the load comprises a plurality of LED strings respectively connected to the drain of the corresponding MOS transistor.

3. The driving circuit as claimed in claim 1, wherein the comparing module comprises a voltage comparator.

4. The driving circuit as claimed in claim 2, wherein the comparing module comprises a voltage comparator.

5. A LED backlight module comprising a driving circuit as claimed in claim 1.

6. The LED backlight module as claimed in claim 5, wherein the comparing module comprises a voltage comparator.

7. The LED backlight module as claimed in claim 6, wherein the load comprises a plurality of LED strings respectively connected to the drain of the corresponding MOS transistor.

8. The LED backlight module as claimed in claim 5, wherein the load comprises a plurality of LED strings respectively connected to the drain of the corresponding MOS transistor.

* * * * *